US007494037B2

(12) United States Patent
Simonelli et al.

(10) Patent No.: US 7,494,037 B2
(45) Date of Patent: Feb. 24, 2009

(54) FASTENER DRIVING DEVICE

(75) Inventors: David Simonelli, Coventry, RI (US); Charles Hewitt, Warwick, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 0 days.

(21) Appl. No.: 11/432,669

(22) Filed: May 12, 2006

(65) Prior Publication Data

US 2007/0007319 A1 Jan. 11, 2007

Related U.S. Application Data

(60) Provisional application No. 60/680,021, filed on May 12, 2005.

(51) Int. Cl.
*B25C 7/00* (2006.01)

(52) U.S. Cl. ..... 227/132; 227/131; 267/148; 267/166; 173/202

(58) Field of Classification Search ..... 227/8, 227/120, 131, 132; 173/202, 203; 267/162, 267/166, 148, 149
See application file for complete search history.

(56) References Cited

U.S. PATENT DOCUMENTS 1,767,485 A * 6/1930 Shallenberger ..... 227/147
1,845,617 A * 2/1932 Metcalf ..... 227/96
2,574,875 A * 11/1951 Lang ..... 227/96
2,852,424 A 9/1958 Reinhart et al.
3,243,023 A 3/1966 Boyden
3,305,156 A * 2/1967 Khan ..... 227/132
3,378,426 A 4/1968 Medney
3,586,231 A * 6/1971 Wilson ..... 227/111
3,589,588 A * 6/1971 Vasku ..... 227/132
3,810,572 A 5/1974 Malkin
3,847,322 A * 11/1974 Smith ..... 227/132
3,924,789 A 12/1975 Avery et al.
3,982,678 A * 9/1976 Olson ..... 227/63
4,012,267 A 3/1977 Klein
4,260,143 A 4/1981 Kliger
4,380,483 A 4/1983 Kliger
4,434,121 A 2/1984 Schäper
4,473,217 A 9/1984 Hashimoto
4,483,280 A 11/1984 Nikolich
4,544,090 A 10/1985 Warman et al.
4,544,610 A 10/1985 Okamoto et al.
4,564,048 A * 1/1986 Taylor ..... 138/31
4,714,186 A 12/1987 Williamson
4,724,992 A * 2/1988 Ohmori ..... 227/146
4,756,602 A 7/1988 Southwell et al.

(Continued)

FOREIGN PATENT DOCUMENTS

DE 3037616 A1 5/1982

(Continued)

*Primary Examiner*—Scott A. Smith
(74) *Attorney, Agent, or Firm*—Pillsbury Winthrop Shaw Pittman LLP

(57) ABSTRACT

A fastener driving device is disclosed. The device includes a housing assembly, and a nose assembly connected to the housing assembly. The device also includes a magazine for carrying a supply of fasteners that are provided to the nose assembly, a fastener driver, and a spring that moves the fastener driver through a drive stroke. The spring includes a composite material. The device also includes a motor for moving the fastener driver through a return stroke.

21 Claims, 4 Drawing Sheets

U.S. PATENT DOCUMENTS

| | | | | | |
|---|---|---|---|---|---|
| 4,773,633 | A | | 9/1988 | Hinz et al. | |
| 4,865,229 | A | | 9/1989 | Schneider et al. | |
| 4,907,802 | A | | 3/1990 | Gatin et al. | |
| 4,984,800 | A | | 1/1991 | Hamada | |
| 4,991,827 | A | | 2/1991 | Taylor | |
| 5,129,383 | A | | 7/1992 | Rutten | |
| 5,503,783 | A | | 4/1996 | Nakagawa et al. | |
| 5,511,715 | A | | 4/1996 | Crutcher et al. | |
| 5,549,370 | A | | 8/1996 | Folsom | |
| 5,597,431 | A | | 1/1997 | Grosjean et al. | |
| 5,603,490 | A | * | 2/1997 | Folsom | 267/149 |
| 5,678,809 | A | * | 10/1997 | Nakagawa et al. | 267/148 |
| 5,685,525 | A | | 11/1997 | Oguri et al. | |
| 5,720,423 | A | | 2/1998 | Kondo et al. | |
| 5,842,935 | A | | 12/1998 | Nelson | |
| 5,927,585 | A | * | 7/1999 | Moorman et al. | 227/132 |
| 5,988,612 | A | | 11/1999 | Bertelson | |
| 6,068,250 | A | * | 5/2000 | Hawkins et al. | 267/162 |
| 6,186,386 | B1 | | 2/2001 | Canlas et al. | |
| 6,454,251 | B1 | | 9/2002 | Fish | |
| 6,612,556 | B2 | | 9/2003 | Petrina | |
| 6,729,971 | B2 | | 5/2004 | Caldwell | |
| 6,766,935 | B2 | * | 7/2004 | Pedicini et al. | 227/131 |
| 6,886,730 | B2 | | 5/2005 | Fujisawa et al. | |
| 6,899,260 | B2 | | 5/2005 | Sun | |
| 6,971,567 | B1 | * | 12/2005 | Cannaliato et al. | 227/2 |
| 6,986,203 | B2 | * | 1/2006 | Chiu | 29/896.9 |
| 6,997,367 | B2 | | 2/2006 | Hu | |
| 7,137,541 | B2 | * | 11/2006 | Baskar et al. | 227/120 |
| 2005/0218184 | A1 | | 10/2005 | Buck et al. | |
| 2006/0180631 | A1 | | 8/2006 | Pedicini et al. | |

FOREIGN PATENT DOCUMENTS

| | | |
|---|---|---|
| FR | 1200649 | 12/1959 |
| JP | 55014247 | 1/1980 |

* cited by examiner

FASTENER DRIVING DEVICE

This application claims priority to U.S. Provisional Application No. 60/680,021, filed May 12, 2005, the contents of which are incorporated herein by reference.

BACKGROUND OF THE INVENTION

1. Field of the Invention

The present invention relates to fastener driving devices. More specifically, the present invention relates to fastener driving devices.

2. Description of Related Art

Fastening tools are designed to deliver energy stored in an energy source to drive fasteners very quickly. Typically fastener driving devices use energy sources such as compressed air, flywheels, and chemicals (fuel combustion & gun powder detonation). For some low energy tools, steel springs are used. For example, U.S. publication No. US2005/0006428 (A1) discloses a small cordless brad tool. U.S. Pat. No. 6,997,367 to Hu discloses a hand held nailing tool for firing small nails.

It is desirable for fastener driving devices to provide sufficient energy to effectively drive the fastener, but with minimum recoil. It is also desirable for the tool to be of low weight so that it may be used with one hand, and not cause excessive fatigue. Recoil may be a two-fold effect. First, it may negatively impact the tool's ability to drive the fastener, and, second, it may increase user fatigue.

Recoil is a function of, among other things, the tool weight/driver weight ratio, and driver velocity (drive time). A typical pneumatic tool has a tool/driver ratio of greater than 30. Drive time is typically less than 10 milliseconds (msec.) and should not be greater than 20 msec. Maximum pneumatic tool weight is found with the bigger tools—e.g., framing nailers. An estimated maximum limit to an acceptable tool weight is 10 lbs. Framing nailers in the 8 to 9.5 lb. range are typically used without excessive fatigue. Combining the limits on the tool/driver weight ratio of 30 and a 10 lb. maximum tool weight, the limit on the driver weight becomes about 0.33 lb. That is, the driver weight should preferably be less than 0.33 lb. if the tool weighs 10 lbs. In other words, if the driver (mechanism in the tool that drives the fastener) weighs more than 0.33 lb., the tool weight would have to be greater than 10 lb. to counteract the recoil sufficiently for comfortable operation.

One of the reasons for the quick drive time requirement is the dual requirement of energy and force. The energy is stored in a moving mass and can be found from Energy=½ mass× velocity squared, i.e. $E=\frac{1}{2}mv^2$. The force is developed from the change in momentum when the driver pushes the fastener into the work piece. An impulsive force is equal to a change in momentum. Assuming an average force during the drive and the final velocity of the moving mass is zero, a simple equation may be set up where force×time=mass×velocity, or time=mass×velocity/force.

In general, the event of driving most fasteners occurs in fewer than 10 msec., which would allow for a rate of 100 cycles per second. Of course, this time does not take into consideration the reset time. Pneumatic tool cycle rates typically range from approximately 30 cycles per second for very small energy tools such as upholstery staplers, to approximately 10 cycles per cycles per second for larger energy tools, for example, tools that are used in framing. In most applications, the desired rate is no more than 10 cycles per second, which allows for 100 msec. per actuation.

The constraint of the drive time being less than 10 msec. is still desirable to minimize the recoil of the tool, and is also important in adequately driving the nail. Of course, these factors are inter-related in that if the tool does not adequately drive the nail, recoil will typically be more severe. As stated above, recoil is a function of many things, but a primary physical consideration is the ratio between the tool weight and the weight of the driver. This is due to the energy requirement of driving a fastener being constant. Also, the law of conservation of momentum requires that the final velocity of the tool (assuming the tool velocity is zero at the start) will be equal to the ratio between the mass of the tool and the mass of the driver times the final velocity of the driver. The output energy of the tool (when no fastener is driven) is equal to ½ the mass of the driver times the square of the final velocity of the driver ($\frac{1}{2}\times m\times v^2$). Combining these two and simplifying, the final velocity of the tool may be found from:

$$V_{tool} = \sqrt{\frac{2m_{striker}Energy}{m_{tool}^2}} \tag{1}$$

Holding the mass of the tool and energy constant, the only practical way to decrease the tool velocity is to decrease the mass of the driver. As the driver gets lighter, its final velocity should increase to obtain the required energy. Given that time is equal to distance divided by velocity, and assuming that average velocity is about half peak velocity for most fasteners, the optimal time to drive is between 3 and 10 msec.

One problem with a short drive time is the high power requirement it creates. Given that power is output energy divided by time, as the time decreases for a given energy, the power increases. Although most applications allow 100 msec. per actuation, an improved drive allows 10 msec. or less, and realizes at least a 10 fold increase in power. This creates the need for some sort of energy storage device that can be released in 10 msec. or less.

Direct chemical energy can be released in less than 10 msec., but direct chemical energy in discrete actuations has other costs and complexities that make it limited at the present time. However, chemical energy based tools typically cannot provide "bump fire" capability where the trigger is depressed, and the contact trip is depressed to start a drive sequence. Another form of energy storage that allows for the storage and rapid release of energy is the flywheel. Mechanical flywheel type cordless fastening tool proposed in U.S. patent application US2005/0218184(A1) maintains a constant flywheel speed, while the tool proposed in U.S. Pat. No. 5,511,715 does not maintain a constant flywheel speed. However, one recognized problem with a flywheel is long term energy storage, which creates a need to get the total required energy for a first actuation into the flywheel before the perceived actuation delay time which is approximately 70 msec. In particular, from a user's perspective, the maximum delay from when the contact trip is depressed, to when the nail is driven, is approximately a 70 msec. Tools having larger actuation delay time will typically be deemed unacceptable for use in bump fire mode. Thus, flywheel based tools must maintain constant rotation of the flywheel while the trigger is depressed to have such bump fire capability, thus wasting significant energy. Another problem with a flywheel is the energy transfer mechanism is complicated and inefficient.

Other prior art references peripherally related to the fastener driving devices include U.S. Pat. No. 5,720,423 that provides a discussion as to why a traditional steel spring cannot be effectively used to drive a nail, U.S. Patent application US2005/0220445(A1) that discloses a cordless fastener driving device with a mode selector switch, and U.S. Pat. No. 3,243,023 that discloses a clutch mechanism.

BRIEF SUMMARY OF THE INVENTION

It is an aspect of the present invention to provide a lightweight and efficient fastener driving device that provides sufficient energy to drive a fastener.

Another aspect of the present invention is to provide such a fastener driving device that allows bump fire actuation.

In an embodiment of the invention, a fastener driving device is provided. The device includes a housing assembly, and a nose assembly connected to the housing assembly. The device also includes a magazine for carrying a supply of fasteners that are provided to the nose assembly, a fastener driver, and a spring that moves the fastener driver through a drive stroke. The spring includes a composite material. The device also includes a motor for moving the fastener driver through a return stroke.

In an embodiment of the invention, a fastener driving device is provided including a housing assembly, and a nose assembly connected to the housing assembly. The device also includes a magazine for carrying a supply of fasteners that are provided to the nose assembly, a fastener driver, and a spring that moves the fastener driver through a drive stroke. The spring has a weight of about 1.0 lb. or less, and a natural frequency of greater than about 20 Hz, and preferably, greater than about 25 Hz. The device also includes a motor for moving the fastener driver through a return stroke.

Other aspects, features, and advantages of the present invention will become apparent from the following detailed description, the accompanying drawings, and the appended claims.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE INVENTION

Figure 1:
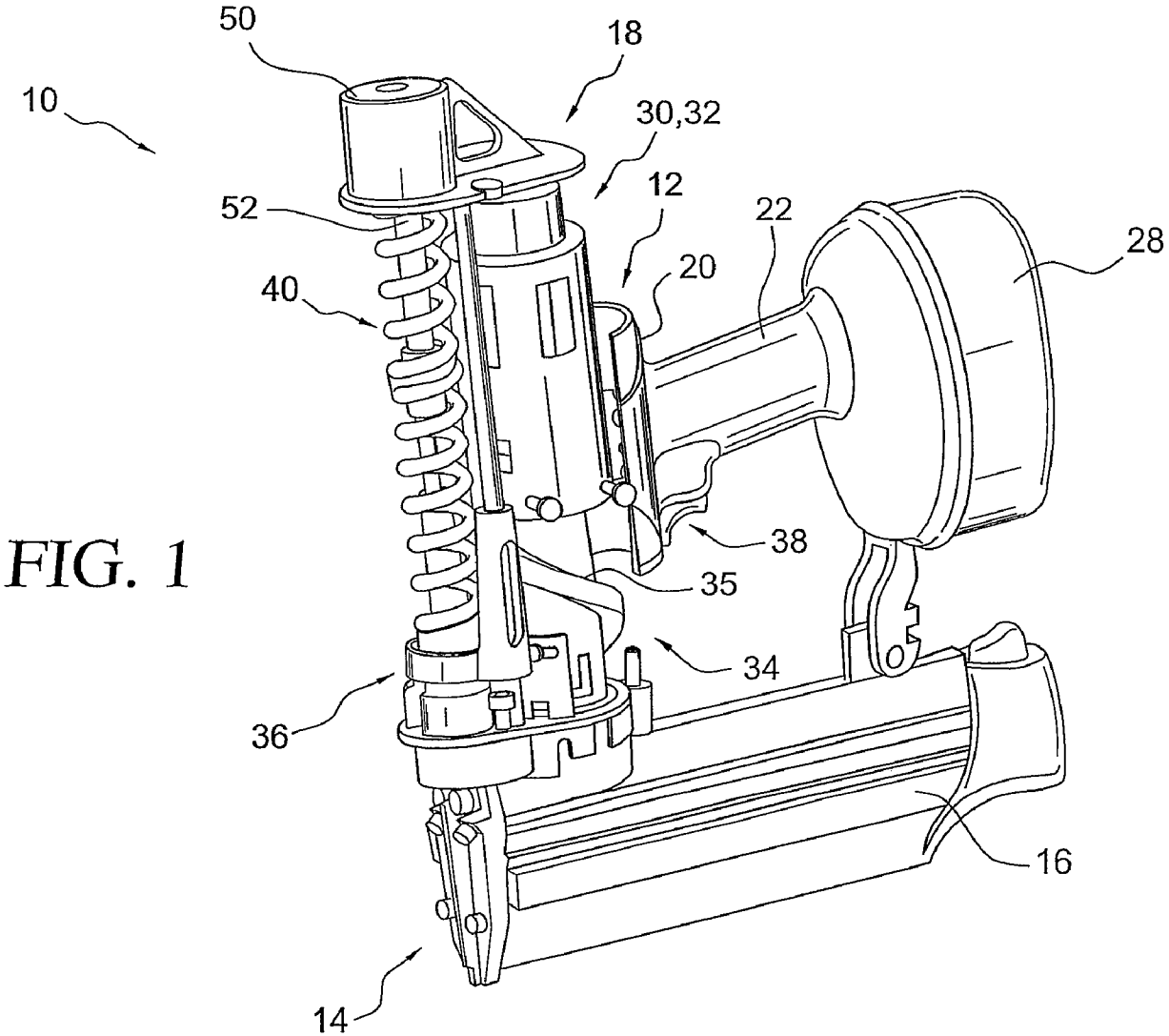
FIG. 1 is a perspective view of a fastener driving device according to an embodiment of the present invention, with a portion of its housing removed.

FIG. 1 illustrates an embodiment of a fastener driving device 10 according to the present invention. As shown, the fastener driving device 10 includes a housing assembly 12, a nose assembly 14, and a magazine 16 that is operatively connected to the nose assembly 14 and is supported by the housing assembly 12. The device 10 also includes a power operated system 18 that is constructed and arranged to drive fasteners that are supplied by the magazine 16 into a workpiece.

The housing assembly 12 includes a main body portion 20, and a handle portion 22 that extends away from the main body portion 20, as shown in FIG. 1. The majority of the main body portion 20 is removed in FIG. 1 so that features contained within the main body portion 20 may be more easily viewed. The handle portion 22 is configured to be gripped by the user of the fastener driving device 10.

The nose assembly 14 is connected to the main body portion 20 of the housing assembly 12. The nose assembly 14 defines a drive track (not shown) that is configured to receive a fastener driver 26. The drive track is constructed and arranged to receive fasteners from the magazine 16 so that they may be driven, one by one, into the workpiece by the power operated system 18, as will be discussed in further detail below.

In the illustrated embodiment, the power operated system 18 includes a power source 28, a motor 30, a reduction gear box 32 connected to the motor 30, a cam 34 that is operatively connected to the motor 30 via the gear box 32, a driver/lift assembly 36, a trigger 38, and a spring 40.

As shown in the Figures, the power source 28 is a battery, although the illustrated embodiment is not intended to be limited in any way. It is contemplated that other types of power sources may be used for powering the motor. For example, it is contemplated that the motor may be electrically operated with a power cord connected to an outlet, or be pneumatically operated. In addition, a fuel cell may be utilized to allow the fastener driving device to be portably implemented. Of course, these are examples only, and the power source may be implemented differently in other embodiments.

The motor 30 is powered by the power source 28 and is configured to provide rotational movement to the cam 34 via the gear box 32. The gear box 32 is configured to provide the proper gear ratio between the motor 30 and the cam 34 such that the cam 34 rotates the desired amount at the desired speed. For example, the gear box 32 may be a reduction gear box so that the rotational speed of the motor 30 may be reduced prior to rotating the cam 34.

The cam 34 includes a cam surface 35 on an outer portion thereof. As shown in the Figures, the cam surface 35 is substantially helical in shape so that it may provide linear translation of a part that follows the cam surface 35, as the cam 34 rotates.

The driver/lift assembly 36 is moved upwardly through a return stroke via the cam 34, and more particularly via the cam surface 35. The driver/lift assembly 36 includes a body 42 and the fastener driver 26, which is attached to the body 42. The body 42 and the fastener driver 26 are movable between a drive stroke, during which the fastener driver 42 drives the fastener into the workpiece, and a return stroke. The driver/lift assembly 36 also includes a guide 46 for guiding the substantially linear movement of the body 42. In an embodiment, the guide 46 is disposed such that it is substantially parallel to the drive track, so that the body 42, and, therefore, the fastener driver 26 move linearly. The drive/lift assembly 36 further includes a cam follower 48 that is operatively connected to the body 42 such that it moves with the body 42. The cam follower 48 may be a separate piece that is either directly connected, or connected with an intermediate piece, to the body 42.

Figure 2:
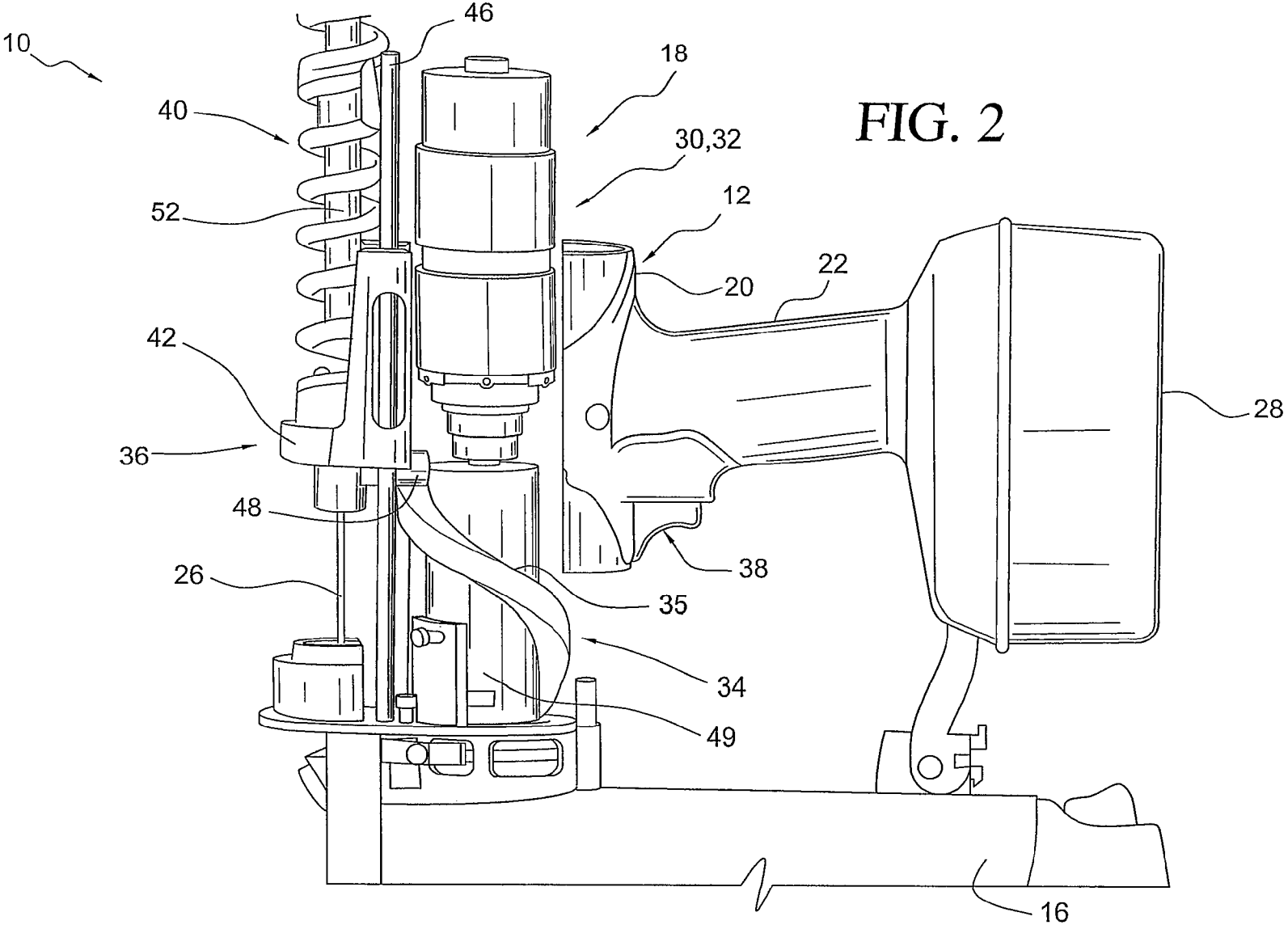
FIG. 2 is another perspective view of the fastener driving device of FIG. 1, with a fastener driver in a ready-to-strike position.
Figure 3:
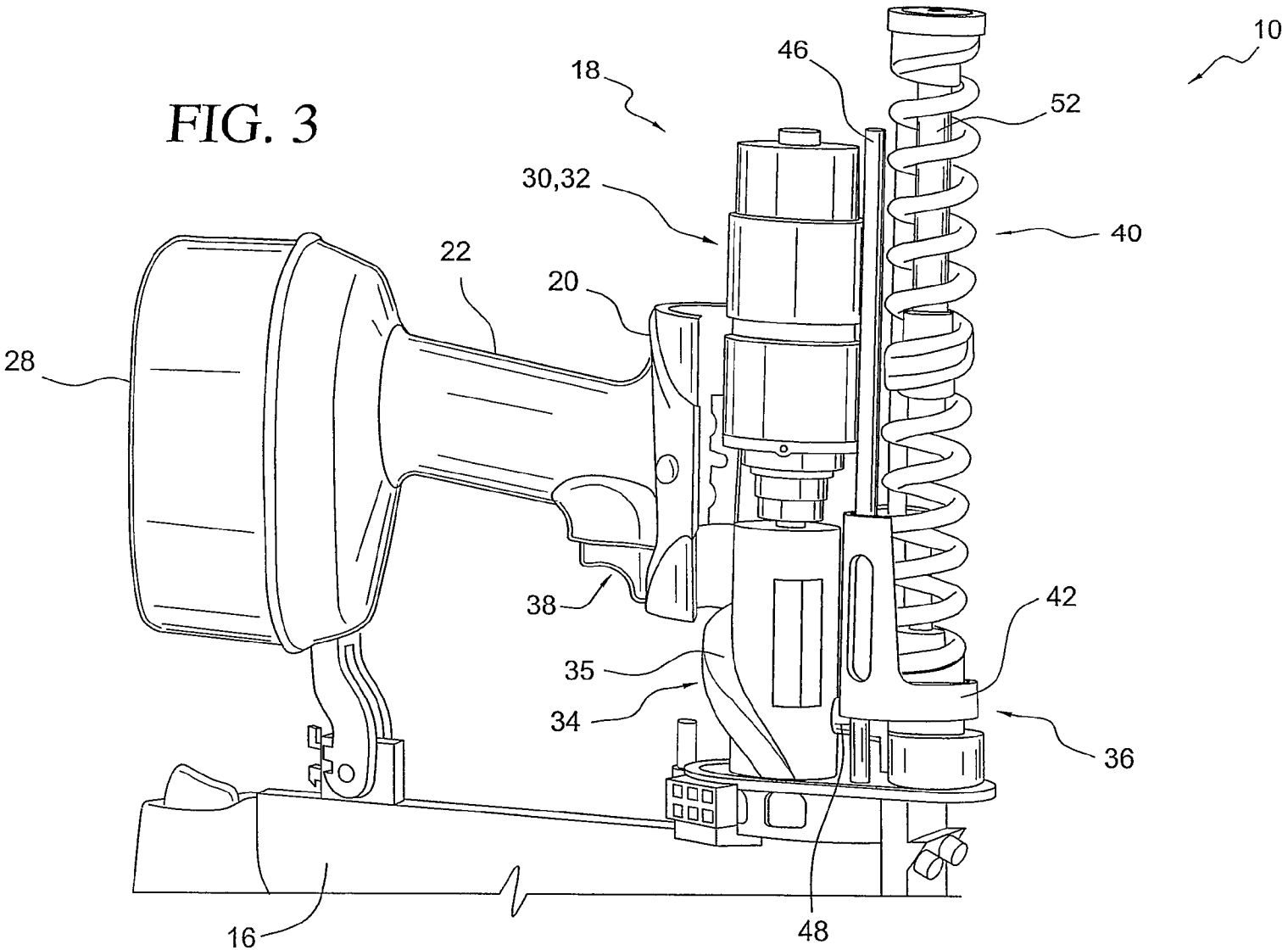
FIG. 3 is another perspective view of the fastener driving device of FIG. 1.

The cam follower 48 is shaped and sized to interact with the cam surface 35 of the cam 34 so that when the cam 34 rotates, the cam follower 48 follows the cam surface 35 and allows the body 42 to be pushed upward when the cam 34 is rotated by the motor 30, as shown in FIG. 2.

The spring 40 is disposed between, and connected at each end to the body 42 and an end cap 50. A spring guide 52 that is connected to the end cap 50 may also be used to help guide the spring 40 as it compresses and expands. Thus, as the body 42 is pushed upward when the cam 34 is rotated by the motor 30, the spring 40 is compressed. Once the body 42 reaches a predetermined height, the cam follower 48 falls off of the cam surface 35, thereby allowing the body 42 to move independently from the cam 34. Without resistance being provided by the cam 34, the energy now stored in the spring 40 is released, thereby moving the body 42 and the fastener driver 24 through the drive stroke. As the cam follower 48 falls off of the cam surface 35, it typically kicks the cam 34 back in the direction opposite to the direction that compresses the spring 40. In this regard, a cam return 49, which may be a torsion spring, ensures that the cam 34 is returned to its initial position so that the cam follower 48 may be reengaged with the cam surface 35, so the device 10 is ready for the return stroke, and the next drive stroke thereafter.

The device 10 also further includes a safety mechanism that includes a trigger 38 and a contact trip assembly (not shown). The contact trip assembly is commonly found on pneumatic fastener driving devices, and such an assembly is described, for example, in U.S. Pat. No. 6,186,386, which is incorporated herein by reference. The device 10 may be used in both sequential and contact modes. The contact trip assembly described in U.S. Pat. No. 6,186,386 is not intended to be limiting in any way, and is incorporated merely as an example.

The trigger 38 is also in communication with a controller (not shown), and the controller communicates with the motor 30. Upon receiving a signal from the trigger 38, and/or the contact trip assembly, the controller signals the motor 30 to energize for a predetermined amount of time, which causes the cam 34 to rotate, thereby initiating a drive stroke. After completion of the drive stroke, the controller signals the motor to energize for a shorter time so that the cam 34 may rotate a predetermined amount to partially compress the spring 40, which reduces the amount of time needed to fully compress the spring 40 during the next drive stroke. The controller is preferably programmed such that after a predetermined amount of time in which the device 10 has not been used, the body 42 is allowed to return to a position in which there is no load on the spring 40.

Because the energy that is used to drive the fastener during the drive stroke is temporarily stored in the spring 40, the power and drive time of the device 10 is a function of, among other things, the design of the spring 40. In accordance with one aspect of the present invention, a composite spring is used in order to derive enhanced efficiency and power in comparison with prior art tools that employ metal springs. In one embodiment, the device 10 produces more than 40 joules of driving energy. As will be discussed in further detail below, as the energy requirements of the tool increase, the size and weight of a prior art steel spring increase to the point of becoming undesirable. Also, because the stroke used to drive larger fasteners is longer than the stroke used to drive smaller fasteners, the spring release velocity may become a restriction, and the weight of the spring may become more of an issue. In addition, an acceptable useful life of a steel spring becomes harder to fulfill in a more powerful tool, because as the energy requirements increase, the size of the spring increases, and the stress distribution and, hence, integrity of the material, may become a larger factor. Also, problems associated with vibrations tend to get larger due to the weight of the spring itself, as the size and energy storage increases.

It has been found that a composite spring, i.e., a spring that has been manufactured from a composite material, has a high weight to stiffness ratio, has good dynamic efficiency (able to release work quickly), is able to withstand high dynamic loading, and is able to dampen out oscillations quickly. For example, comparing the values of steel and S-2 Glass (a common glass used in composite manufacture) the following results are obtained. If the values for steel were used in a commonly known energy/volume equation, an energy/volume value would be: E/V=1.5e7, and for S-2 Glass Fiber wound on OD only E/V=3.4e8, or 22 times as efficient as steel. A further advantage is found in the energy/mass as the density of steel is 7850 kg/m$^3$ and the density of a composite spring made as described is ~1915 kg/m$^3$, or 4 times less.

In the area of response, a composite spring in accordance with one embodiment of the invention has a rate of greater than 600 kg/m, a mass of less than 1 lb., and a drive time of less than 20 msec., and more preferably less than 15 msec. A sample spring has been designed that has a rate of 1000 kg/m (which would equal 90 kg force or 883 N at 90 mm), with a mass of 0.104 kg. Its frequency may be estimated to be $0.5\times[1000\times9.8/0.104]^{1/2}=154$ Hz. This is close to twice to the idealized calculated value for a steel spring. Theoretically, the cycle time would be 1/154, or 6.5 msec., so the drive time would be one-half this, or 3.25 msec. for a spring made of fiber glass and epoxy.

Another advantage in the composite spring lies in its ability to release more of its stored energy during the initial drive. A load curve for a steel spring would show more fluctuations than a composite spring as the mass inertia of the individual coils would cause the spring to behave as a number of separate mass spring systems. In general, the release phenomena are closely related to the natural frequency of the spring. The higher the natural frequency, the better the spring will respond, and the lower the influence on life from dynamic loads.

Another advantage of the weight density of the composite spring is in operator comfort. As the energy requirements get higher, the relative weight advantage increases to a point where the steel spring is no longer practical, but the composite has not become a major issue.

A strain energy storage source, such as the spring 40, should be mechanically coupled to the fastener driver 26 to drive the fastener. The act of coupling the spring 40 to the driver 26 imparts a portion of the mass of the spring 40 to the driver 26. A typical value is ⅓ of the spring mass. Based upon a driver weight limit of 0.33 lb. for a 10 lb. tool, the mass of the spring in accordance with one aspect of the invention is less than 1.0 lb. In accordance with one aspect of the invention, the tool weighs 10 lbs. or less, and the mass of the spring is 1 lb. or less. In addition, the driver 26 that is attached to the spring has some mass so the actual spring/driver subassembly has a weight of 0.33 lbs. or less.

The effectiveness of a spring material may be gauged by its energy storage density. If the spring weight is limited to 1 lb., then a tool that utilizes 400 in-lbs of energy would use a spring material capable of storing 400 in-lb per pound of material and a 200 in-lb tool would use a spring capable storing 200 in-lb/lb, etc.

As discussed above, a drive time of less than about 20 msec. can be achieved in accordance with the present invention. Natural frequency of the spring system is used to estimate drive time, because, as shown in the examples above, the drive time is half of the inverse of the natural frequency. In addition, more than 40 joules of energy of the tool is achieved.

A coefficient to compare spring materials has been created, using both energy density and drive time, by dividing the energy density with the drive time yielding a coefficient with in-lb/lb-sec units. From the above analysis, the minimum coefficient for a 400 in-lb tool would be 20,000 (drive time of 20.0 msec.). Table 1 below outlines this discussion by comparing the above extreme values to a range of the common spring materials, and also a composite material. Table 1 was derived from well established coil spring design theory. A coil spring was selected for this example because a coil spring has proven to be the most efficient spring geometry. Similar tables can be created with other types of spring geometries, but the values will typically be lower.

TABLE 1 typical data for a large coil spring geometry. (Unless otherwise noted, data is calculated based on 400 in-lb optimized spring design.)

| | Prior Art Music Wire | Prior Art Chrome Vanadium | Prior Art Beryllium Copper | Prior Art 17-7 Stainless | Present Invention Glass Epoxy (test data) |
|---|---|---|---|---|---|
| Design Energy (in-lb) | 400 | 400 | 400 | 400 | 369 |
| Spring Weight (lb.) | 1.3 | 2.3 | 2.27 | 2.46 | 0.32 |
| Energy Density (in-lb/lb) | 308 | 174 | 176 | 163 | 1153 |
| Natural Frequency (Hz) | 10 | 15 | 9 | 14 | 38 |
| Equivalent Drive time (msec.) | 48.7 | 33.3 | 54.2 | 35.7 | 13.2 |
| Spring Tool Coefficient (in-lb/lb-sec) | 6314 | 5217 | 3249 | 4553 | 87638 |

Table 1 shows that commonly used spring materials are inadequate for a 400 in-lb spring powered fastener driving device. The Glass/Epoxy (composite) material combination, however, is shown to be more than adequate with a spring tool coefficient of 87,000 in-lb/lb-sec, which is more than 4 times the minimum requirement of 20,000 in-lb/lb-sec. As shown in the table, the spring made from composite material has a weight of less than 1 lb., an energy density of greater than 400 in-lb/lb, a natural frequency of greater than 25 Hz, an equivalent drive time of less than 20 msec., and a spring tool coefficient of greater than 20,000. Using this analysis, the maximum tool energy that the best common spring material (i.e. music wire from Table 1) would be able to support may be determined. For example, it is found that 200 in-lbs is the maximum energy a music wire spring powered tool could practically achieve.

Figure 4:
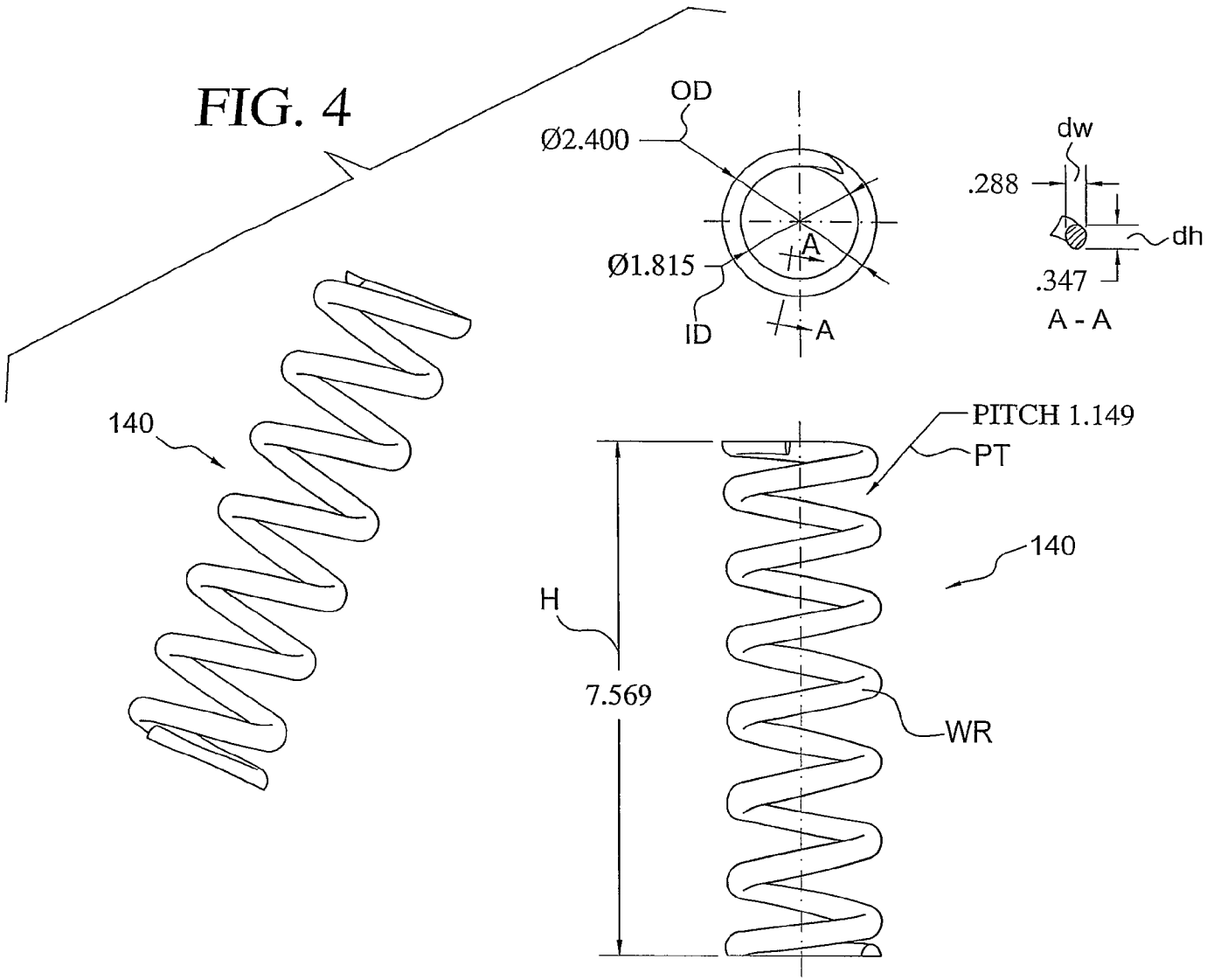
FIG. 4 shows various views of a spring of the fastener driving device of FIG. 1.

A coil spring 140 made from a composite material has been designed to satisfy the target values in Table 1 is shown in FIG. 4. The illustrated spring 140 has an outer diameter OD of about 2.400 inches, and inner diameter ID of about 1.815 inches, and a height H of about 7.569 inches. The "wire" WR of the spring 140 has a substantially elliptical cross-section with a major diameter dh of about 0.347 inches and a minor diameter of about 0.288 inches. The spring may be manufactured with glass fiber and epoxy resin. Wetted fiber may be wrapped around a central core to create the wire WR. The properties of the spring 140 may be varied by changing the pitch PT (and hence pitch angle) and fiber content of the spring 140. The wire WR may then be wound around a lost core mandrel to form its shape. The wire is then subjected to heat, which polymerizes and cures the epoxy resin, and also melts the core. The spring 140 may then be cleaned to prepare it for inclusion in the fastener driving device 10.

The descriptions above are intended to be illustrative, not limiting. Thus, it will be apparent to one skilled in the art that modifications may be made to the invention as described without departing from the scope of the claims set out below.

What is claimed:

1. A fastener driving device comprising:

a housing assembly;

a nose assembly connected to the housing assembly;

a magazine for carrying a supply of fasteners that are provided to the nose assembly;

a fastener driver;

a spring that moves the fastener driver through a drive stroke, wherein the spring comprises a composite material, said spring having a spring tool coefficient of at least 20,000 in-lb/lb-sec; and a motor for moving the fastener driver through a return stroke.

2. A fastener driving device according to claim 1, wherein the composite material comprises glass fibers.

3. A fastener driving device according to claim 2, wherein the composite material further comprises an epoxy resin.

4. A fastener driving device according to claim 1, wherein the composite material comprises an epoxy resin.

5. A fastener driving device according to claim 1, wherein the spring is a coil spring.

6. A fastener driving device according to claim 1, wherein the motor is battery operated.

7. A fastener driving device according to claim 1, further comprising a cam operatively connected to the motor, the cam being constructed and arranged to affect compression of the spring so that energy is stored in the spring before the drive stroke.

8. A fastener driving device according to claim 7, further comprising a safety mechanism configured to signal the motor to affect rotation of the cam and initiate the drive stroke.

9. A fastener driving device according to claim 8, wherein the safety mechanism comprises a contact arm and a trigger, the contact arm and the trigger being cooperatively arranged to provide the signal to the motor.

10. A fastener driving device according to claim 1, further including a spring guide that extends within the spring.

11. A fastener driving device according to claim 1, further including a cam operatively connected to the motor and a cam follower that engages the cam during compression of the spring, wherein rotation of said cam causes compression of said spring, wherein said cam includes a surface that terminates so that the cam follower falls off the surface during the drive stroke of the fastener driver.

12. A fastener driving device according to claim 11, further including a cam return that returns the cam so that the cam is reengaged by the cam follower.

13. A fastener driving device according to claim 12, wherein the cam return includes a torsion spring.

14. A fastener driving device according to claim 1, wherein upon moving the fastener driver through the drive stroke, the motor is operated to rotate the cam a predetermined amount to partially compress the spring, said motor further operable to fully compress said spring after receiving a signal for the drive stroke.

15. A fastener driving device according to claim 14, further including a controller programmed to control the motor.

16. A fastener driving device according to claim 1, wherein the spring has a weight of about 1.0 lb. or less and a natural frequency of at least 38 Hz.

17. A fastener driving device according to claim 1, wherein the spring has an energy/volume value greater than 1.5e7 $J/m^3$.

18. A fastener driving device according to claim 1, wherein the spring has an energy density of at least 400 in-lb/lb.

19. A fastener driving device according to claim 18, wherein the spring has an energy density of at least approximately 1100 in-lb/lb.

20. A fastener driving device according to claim 1, wherein the spring has a spring tool coefficient of at least approximately 87,000 in-lb/lb-sec.

21. A fastener driving device according to claim 1, wherein the spring has an elliptical cross section.

* * * * *

UNITED STATES PATENT AND TRADEMARK OFFICE

CERTIFICATE OF CORRECTION

PATENT NO. : 7,494,037 B2
APPLICATION NO. : 11/432669
DATED : February 24, 2009
INVENTOR(S) : David Simonelli et al.

It is certified that error appears in the above-identified patent and that said Letters Patent is hereby corrected as shown below:

On title page, item (56) References Cited
replace "4,756,602 A 7/1988 Southwell et al."
with --4,765,602 A 8/1988 Roeseler--.

Signed and Sealed this

Eleventh Day of May, 2010

David J. Kappos

David J. Kappos
*Director of the United States Patent and Trademark Office*